US006341438B1

(12) United States Patent
Sianos

(10) Patent No.: US 6,341,438 B1
(45) Date of Patent: Jan. 29, 2002

(54) ADVERTISING DISPLAY DEVICE

(76) Inventor: Evangelo Sianos, 99 Chatham Street East, #1508, Windsor, Ontario (CA), N8A 6V1

( * ) Notice: Subject to any disclaimer, the term of this patent is extended or adjusted under 35 U.S.C. 154(b) by 0 days.

(21) Appl. No.: 08/999,688

(22) Filed: Dec. 18, 1997

Related U.S. Application Data

(63) Continuation-in-part of application No. 08/330,192, filed on Oct. 27, 1994, now abandoned.

(51) Int. Cl.[7] ..... G09F 3/00

(52) U.S. Cl. ..... 40/306; 40/567; 220/908; 220/908.1; 220/909

(58) Field of Search ..... 40/567, 306; 220/908, 220/908.1, 909

(56) References Cited

U.S. PATENT DOCUMENTS

| | | | | | |
|---|---|---|---|---|---|
| 1,364,209 | A | * | 1/1921 | Richardson | 232/1 R |
| 1,380,252 | A | * | 5/1921 | Richardson | 232/43.2 |
| 1,511,982 | A | * | 10/1924 | Schilling | 40/606 |
| 3,309,160 | A | * | 3/1967 | Lewis | 312/308 |
| 3,793,756 | A | * | 2/1974 | Kay et al. | 40/306 |
| 3,803,738 | A | * | 4/1974 | Weiss | 40/306 |
| 3,866,824 | A | * | 2/1975 | Lewis | 232/43.2 |
| 4,577,778 | A | * | 3/1986 | Kim | 220/495.07 |
| 4,809,850 | A | * | 3/1989 | Laible et al. | 206/366 |
| 4,893,722 | A | * | 1/1990 | Jones | 220/503 |
| 4,964,523 | A | * | 10/1990 | Bieltvedt et al. | 220/553 |
| 5,046,635 | A | * | 9/1991 | Haas et al. | 220/524 |
| 5,062,540 | A | * | 11/1991 | Jenkins | 220/23.83 |
| 5,176,256 | A | * | 1/1993 | Sawaya | 206/366 |
| 5,303,841 | A | * | 4/1994 | Mezey | 220/555 |
| 5,381,921 | A | * | 1/1995 | Bray et al. | 220/495.08 |

FOREIGN PATENT DOCUMENTS

| | | | | |
|---|---|---|---|---|
| FR | 1342711 | * | 9/1963 | 220/475 |

* cited by examiner

*Primary Examiner*—B. Dayoan
*Assistant Examiner*—Andrea Chop
(74) *Attorney, Agent, or Firm*—Harness, Dickey & Pierce, P.L.C.; John A. Miller

(57) ABSTRACT

An advertising display device usable for the collection and temporary retention of waste is defined by a hollow container having a movable front panel for accessing the interior. A frame in the interior provides for the emplacement of at least two trash bags to enable separable depositing of different sorts of waste thereinto to increase ease of recycling. At least one transparent layer mounted to the front panel cooperates therewith to define a pocket therebetween for removable emplacement of advertising media therewithin. The device is attachable to a post or other stanchion. In an alternate embodiment, the device is unitary in construction, a hinged top wall provides access to the interior, and multiple removable canisters in the interior enable separable depositing of different sorts of waste thereinto to increase ease of recycling. In the alternate embodiment, at least one divider may be used to separate the interior into multiple compartments.

18 Claims, 6 Drawing Sheets

ADVERTISING DISPLAY DEVICE

CROSS-REFERENCE TO RELATED APPLICATIONS

This application is a continuation-in-part application of co-pending U.S. patent application Ser. No. 08/330,192, entitled "ADVERTISING DISPLAY DEVICE", filed Oct. 27, 1994, and now abandoned, the disclosure of which is incorporated herein by reference.

BACKGROUND OF THE INVENTION

1. Field of the Invention

The present invention concerns advertising display devices. More particularly, the present invention concerns advertising display devices that, also, are useful for waste disposal.

2. Prior Art

The deployment of advertising media on waste collection devices is known. For example, it is commonly known to apply posters to the sides of waste collection bins.

Other devices provide for display of advertising cards. Such a waste collection apparatus employing advertising cards is set forth in U.S. Pat. No. 1,511,982, issued Oct. 14, 1924 to Schilling and entitled "RUBBISH CAN." Schilling teaches a container having a bottom hinged front panel disposed in front of a front wall. An advertising card is inserted and held between the front panel and the front wall. As useful as the Schilling apparatus is, Schilling presents problems to the user. In order to access the interior of the Schilling apparatus to remove waste and debris inserted therein, a separable hood with a flap must be entirely displaced from the apparatus. This removal of the hood is cumbersome and awkward at best.

Thus, an advertising display device that is deployed in conjunction with a device for collecting waste, the device being easily accessible for both the placement of waste thereinto and the removal of waste therefrom as well as the device enabling easy placement of advertising media, would provide an advance in the art.

SUMMARY OF THE INVENTION

The present invention provides an advertising display device comprising: A hollow container comprising a front panel and a rear panel. The front panel includes a top wall, a bottom wall, and a side wall, the top, bottom, and side walls being, preferably, integrally formed. The top wall may also be hingedly attached to the side wall. The top wall has at least two openings formed therethrough through which waste may be deposited into the hollow container. A flap, hingedly secured to the top wall, may cover each opening in the top wall. The front panel is movably secured to the rear panel to enable access to the interior for removal of waste therefrom. A frame, either attached to the front or back panel or freestanding in the hollow interior, enables the removable emplacement of disposable waste containers such as plastic bags or similar devices for collection of waste deposited through the openings in the top wall. Means for displaying advertising media is located on the side wall. In a first embodiment, the means for displaying advertising comprises a clear plastic strip that is attached to the side wall by glue or a similar method of attachment to form a pocket. In a second embodiment, the means for displaying advertising comprises a clear plastic strip that is attached to the side panel by a magnetic strip that goes around the border of the clear plastic strip to form a pocket.

In a third embodiment, the hollow interior is divided into multiple compartments by at least one divider slidably engaging grooves in the panels to enable separable depositing of different sorts of waste into the device to increase ease of recycling. Removable canisters may be emplaced in the hollow interior of the device, one beneath each of the openings in the top wall, to collect waste deposited into the container. These dividers and canisters replace the frame of the first embodiment. At least one of the canisters may be fireproof, thereby enabling cigarettes and other flammable materials to be deposited thereinto.

In a fourth embodiment, removable canisters are used without the dividers of the second embodiment.

The container, the apertures in the top wall, and the canisters may take many shapes, some of these shapes being hexagonal, circular, and square.

In all embodiments, the device further includes means for mounting the device to a post or similar stanchion associated with the rear panel.

The advertising display device of the present invention allows display of advertising media while enabling convenient access to the interior thereof for insertion and removal of waste therefrom.

The present invention will be more completely described in the following detailed description, which can be read in conjunction with the accompanying drawings, in which like reference numerals refer to like elements and in which:

DETAILED DESCRIPTION OF THE PREFERRED EMBODIMENTS

Figures 1, 2, 3:
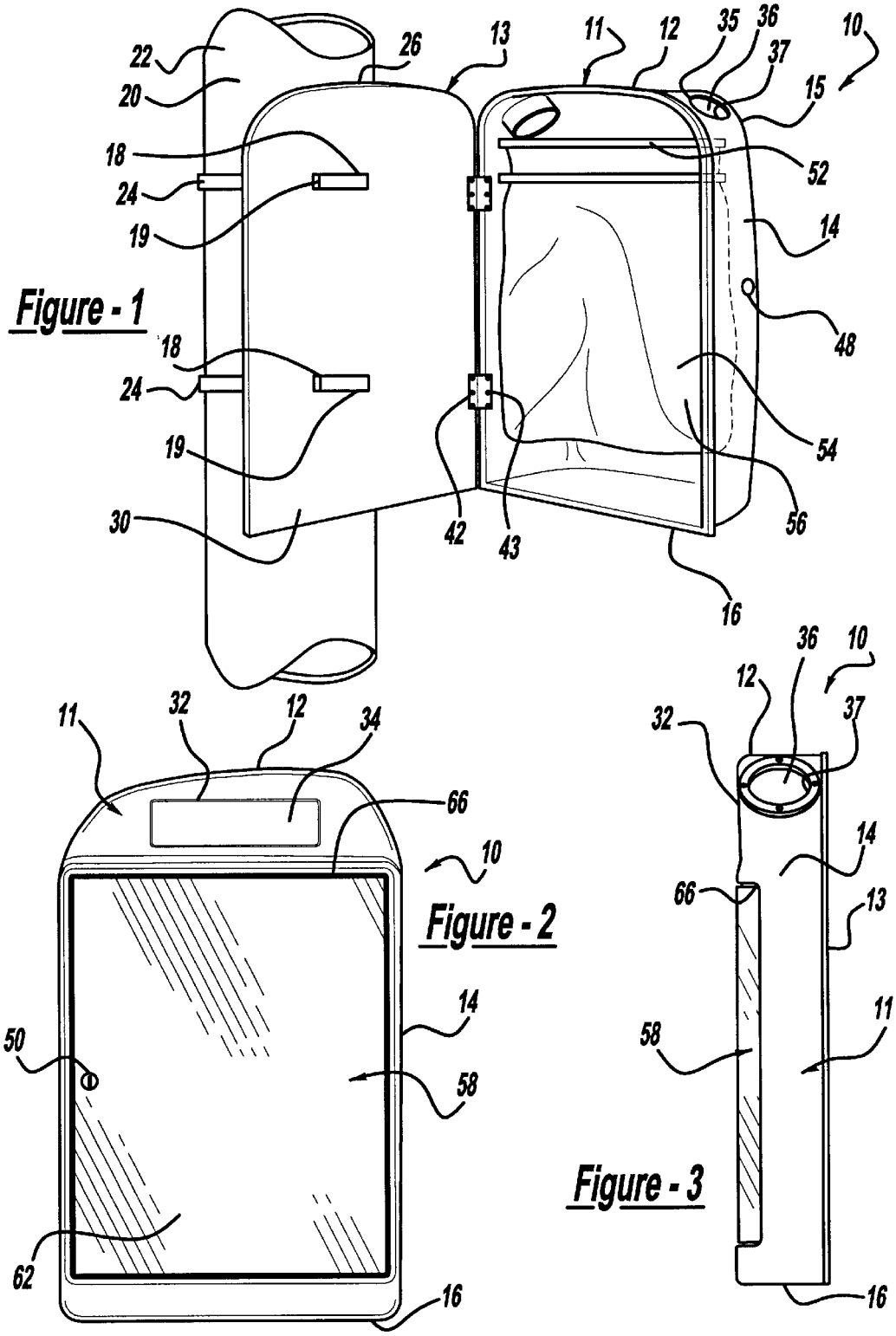
FIG. 1 is an environmental view of a first embodiment of the advertising display device of the present invention depicted as being attached to a pole.
FIG. 2 is a front view of the device of FIG. 1.
FIG. 3 is a side view of the device of FIG. 1.
Figure 4:
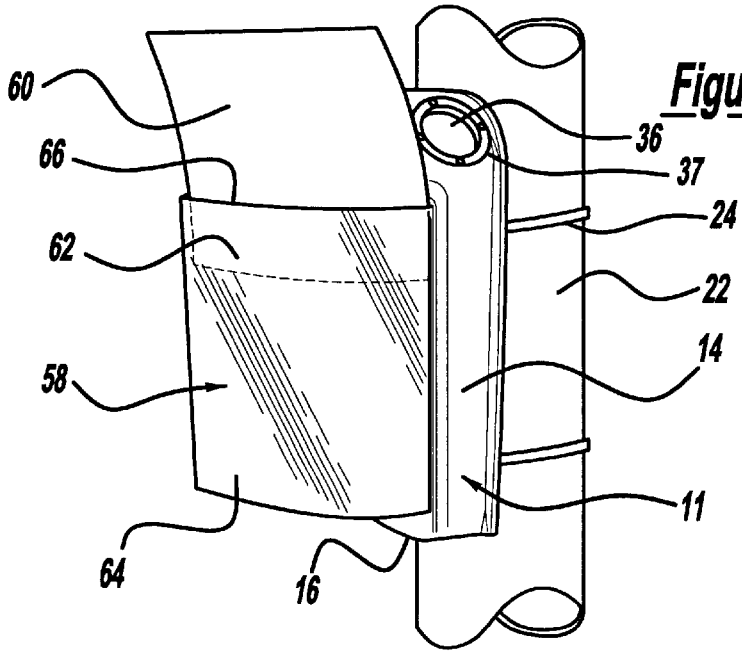
FIG. 4 is a perspective view of the device of FIG. 1 with an advertisement partially attached thereto.

Referring now to the drawing and, in particular, to FIGS. 1–4, there is shown therein a first embodiment of the present invention, to wit, an advertising display device generally denoted as 10. The device 10 includes a front panel 11 and a rear panel 13 which cooperate to define a container with a hollow interior 30 for receiving waste. Each of the front panel 11 and the rear panel 13 has an interior surface and an exterior surface, the interior surfaces of the front panel and the rear panel facing the interior 30 of the hollow container. As shown, the front panel includes a top wall 12, a side wall 14, and a bottom wall 16. The side wall 14 has a top edge 15. The top wall 12, side wall 14, and bottom wall 16 are, preferably, integrally formed. The top wall 12 may also be hingedly attached to the top edge 15 of the side wall 14 in the well-known manner, thereby providing access to the interior 30 of the hollow container.

As can best be seen in FIG. 1, the rear panel 13 has a plurality of spaced apart apertures 18 formed therethrough. Means 19 for mounting the device 10 to a structure 20, such as a post 22, is deployable through the apertures 18. As shown, the means 19 comprises a strapping 24 or the like, which is routed through the apertures 18 and tightened about the post 22 to retain the device 10 thereto. Other means for mounting include, for example, suitable fasteners such as nails, screws, hooks, etc., all of which are well known to the skilled artisan. If not mounted on a pole, the device 10 may also be bolted to the ground via an aperture 17 formed through the bottom wall, or left free-standing, at the option of each user.

As shown, the front panel 11 is movably secured to the rear panel 13, preferably, by a pair of first hinge members 42 vertically disposed along an edge of the front panel 11 and a pair of second hinge members 43 vertically disposed along a corresponding edge of the rear panel 13 in the well-known manner However, the front and rear panels may be welded together or otherwise formed as an integral unit, such as by injection mold, when made of plastic, etc. If the front panel 11 and the rear panel 13 are welded together or otherwise integrally formed, the top wall 12 of the front panel is hingedly attached to the top edge 15 of the side wall 14, in a manner similar to that described hereinabove, in order to provide access to the interior 30 of the hollow container.

As shown, the top wall 12 has a recess 32 formed therein which may have any suitable advertising media 34 or like printed matter emplaced thereon. The media 34 are removably emplaced in the recess 32 by any suitable means, such as glue, paste, or the like.

At least two openings 36, 36' are formed through the top wall 12, through which waste is emplaced into the interior 30. Gaskets 37, 37' surround the openings 36, 36' to cover any sharp edges, thereby preventing cuts or abrasions to a user. The openings 36, 36' are advantageously angularly offset, as shown, to facilitate emplacement of waste and to limit the intrusion of unwanted materials, such as rain water if the device is used outdoors, thereinto. Additionally, as shown in FIG. 1, a hinged flap 35 integrally formed with the top wall 12 may project over each corresponding opening 36, 36' to keep unwanted materials, such as rain water if the device is used outdoors, from entering through the openings 36 or 36'. The apertures 36 and hinged flaps 35 need not all be the same shape.

The front panel 11 hingedly opens from the rear panel 13 as described hereinabove, thereby enabling access to the interior 30.

A latch 48, such as a rotatable bracket 50, is disposed on the front panel 11 and engages the interior wall of the rear panel 13 to keep the device 10 closed. A key operated cylinder may be connected to the latch to prevent unauthorized entry to the interior 30, in the well-known manner.

Figure 8:
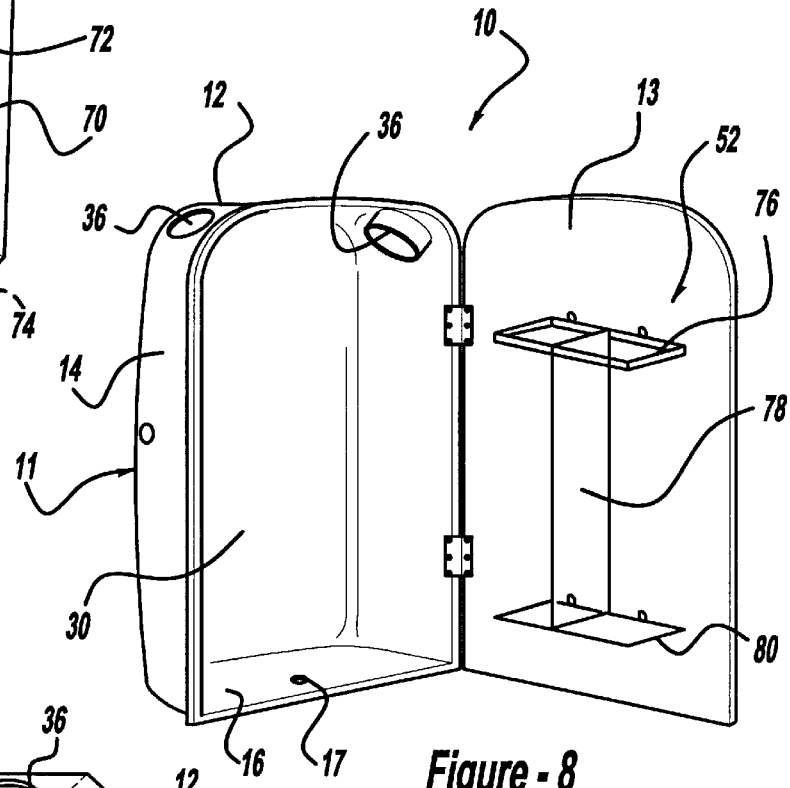
FIG. 8 is an inside view of the device of FIG. 1.

As shown in FIG. 1, a frame 52 may be secured to the inside of the front panel 11. At least one disposable receptacle 54 such as a garbage bag 56 may be removably mounted on the frame member 52 to removably store any waste deposited through the openings 36, 36'. Alternatively, as shown in FIG. 8, the frame 52 may be affixed to the rear panel 13, or may even be free-standing and emplaced in the hollow interior 30 atop the bottom wall 16. The frame 52 shown in FIG. 8 has a top portion 76, a base portion 80, and a support portion 78 extending from the base portion to the top portion. As shown, the top portion 76 is configured to support two bags, though it may be configure to support any convenient number of bags, one below each of the openings formed through the top wall.

Figure 9:
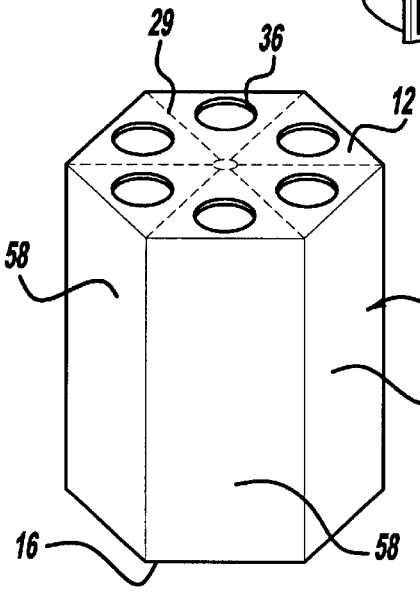
FIG. 9 is a perspective view of the third embodiment of the advertising display device of the present invention.

The device 10 also includes means 58 for displaying advertising indicia provided on the front panel 11. The means 58 comprises a transparent member 62 which surmounts the front panel 11. The transparent member 62 may be attached to the front panel 11 by a variety of means, including glue or tape or the like. The space between the member 62 and the front panel 11 forms a pocket 64. The pocket 64 has an open top 66, through which advertising media 60 can be inserted into the pocket 64. The open top 66 can be sealed by any suitable means, such as tape, to protect the advertising media 60 from damage by the elements. Additionally, there may be multiple such means 58 for displaying advertising media, such as is shown in FIG. 9.

Figure 6:
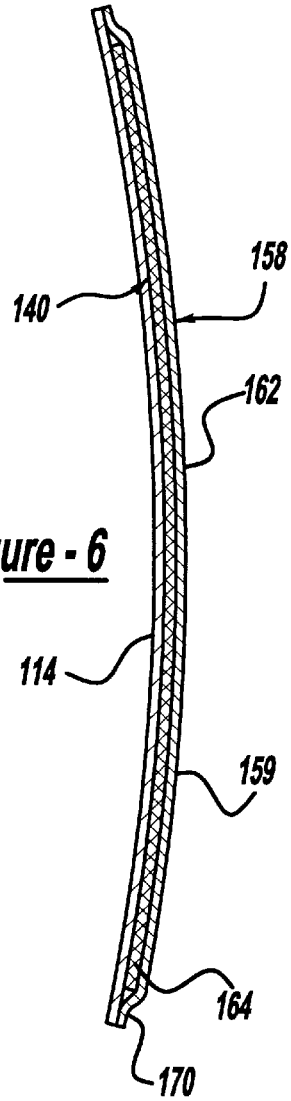
FIG. 6 is a sectional view taken along line 6—6 of FIG. 5.
Figure 5:
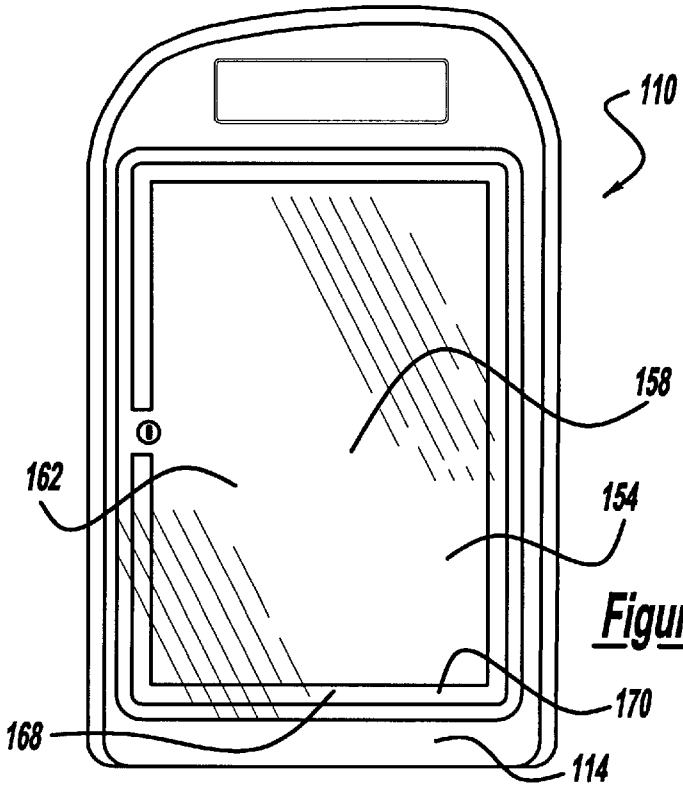
FIG. 5 is a front view of a second embodiment of the present invention.

Referring now to FIGS. 5 and 6, there is depicted therein a second embodiment of the present invention. In accordance herewith, a container 110 includes means 158 for displaying advertising. The means 158 comprises means 159 for connecting a transparent layer 162 to a front panel 114.

The means 159 includes a magnetic border 168 disposed around the perimeter 170 of the transparent layer 162. Thus, the transparent layer 162 may be magnetically secured to the front panel 114. In this manner, advertising media 140 are retained in a pocket 164 formed between the transparent layer 162 and the front panel 114, with the pocket 164 being closed by virtue of the magnetic attraction between the perimetral magnetic border 168 and the front panel 114. In all other respects, the device is similar to that of the first embodiment.

Figure 13:
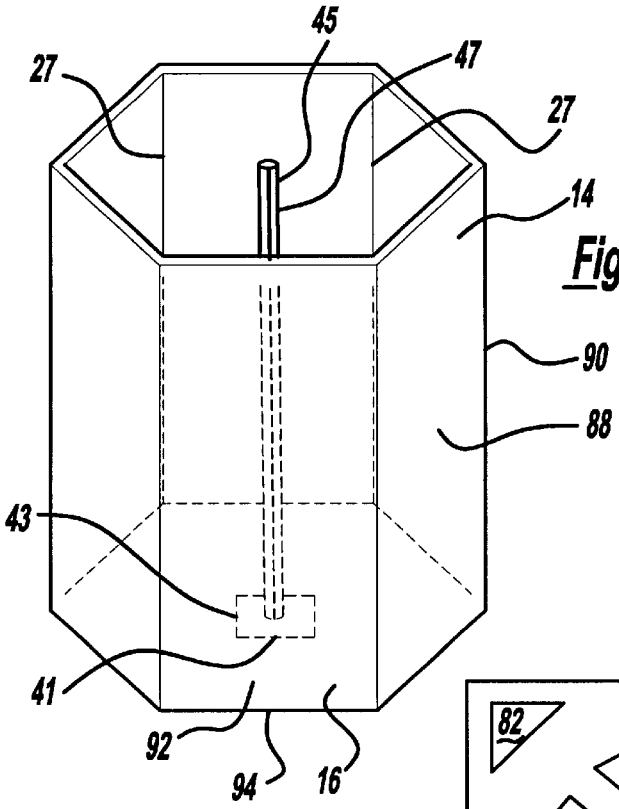
FIG. 13 is a perspective view of the third embodiment hereof.

In a third embodiment of the present invention, and as shown in FIG. 13, the device 10 is unitarily formed, rather than consisting of a front panel and a rear panel. The device has a side wall 14 with an interior surface 88 and an exterior surface 90; a top wall 12 that is hingedly secured to the side wall; a bottom wall 16 that has an interior surface 92 and an exterior surface 94; and a hollow interior. The top wall may be either substantially flat or peaked. The peaked top design is preferred for outdoor use, as a peaked top will allow rainwater to run off, while either the peaked top design or the substantially flat top design is efficacious for indoor use.

Figure 10:
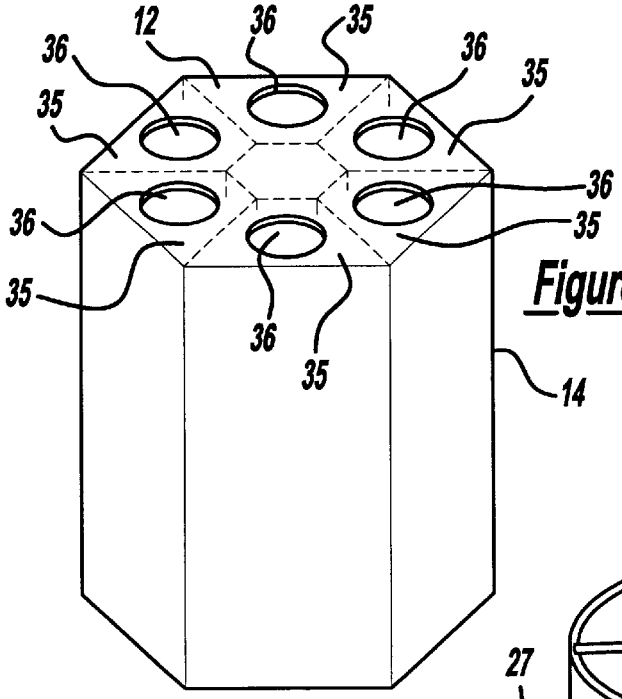
FIG. 10 is a perspective view of the third embodiment hereof.
Figure 11:
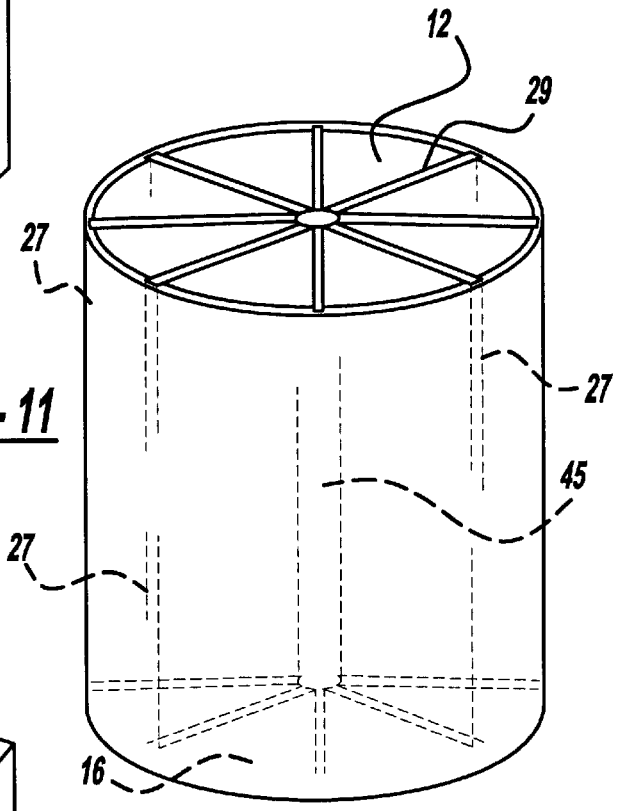
FIG. 11 is a perspective view of the third embodiment hereof
Figure 12:
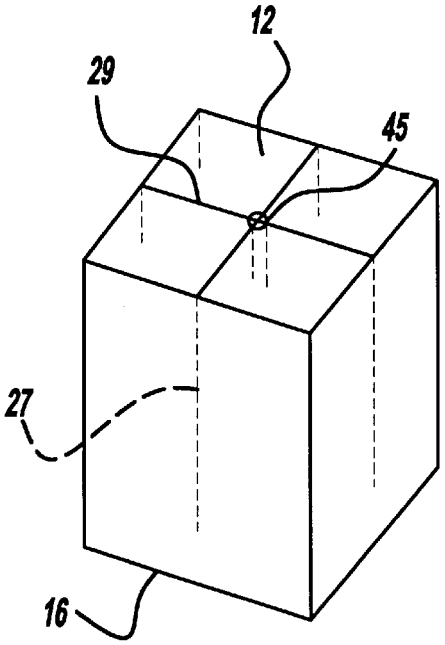
FIG. 12 is a perspective view of the third embodiment hereof.
Figure 14:
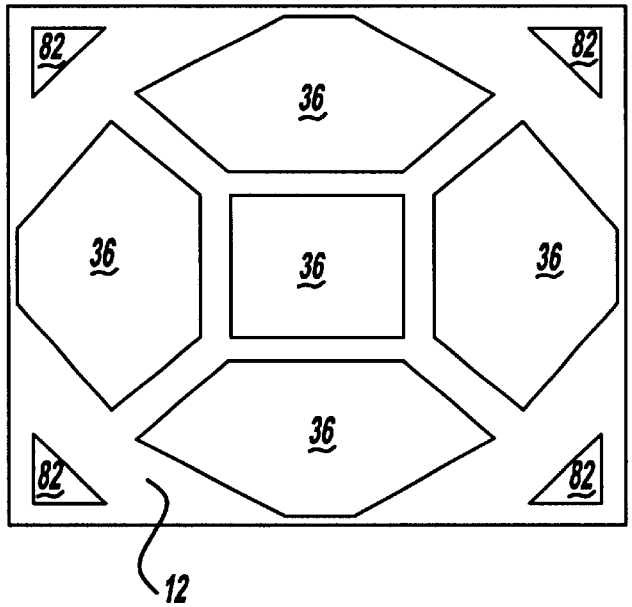
FIG. 14 is a top view of the third embodiment hereof.

It is to be appreciated that the third embodiment may be configured in any convenient form, for instance with a cross-section of a hexagon, as shown in FIGS. 9 and 10; a circle, as shown in FIG. 11; a square, as shown in FIG. 12; etc. Multiple openings 36 may be formed through the top wall 12, as shown in FIGS. 9, 10, and 14.

As shown in FIG. 13, at least one longitudinal groove 27 is formed in the interior surface 88 of the side wall 14. A retention means 41 is formed substantially in the center of the interior surface 92 of the bottom wall 16. The retention means may be an upwardly projecting retaining wall 43 formed integrally with the bottom wall, or an aperture (not shown), or any other retention means known to the skilled artisan. A pole 45 removably fits into the retention means 41, thereby projecting upwardly from the bottom wall 16. At least one longitudinal groove 47 is formed in the pole 45, the number of grooves 47 in the pole 45 corresponding to the number of grooves 27 in the interior wall. The grooves 47 are disposed about the pole 45 such that each groove 47 in the pole faces a corresponding groove 27 in the interior wall when the pole is slid into the retention means 41.

Figure 16:
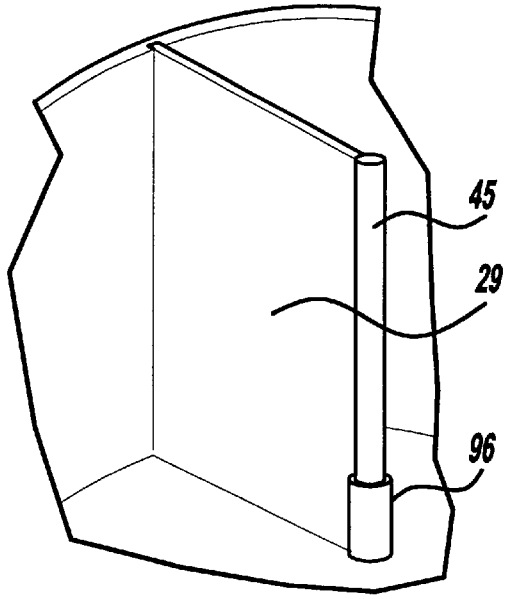
FIG. 16 is a partial side view of a divider and a pole used in the third embodiment hereof.

At least one substantially planar divider 29 is removably attached to the device by slidably engaging the at least one longitudinal groove 27 in the interior surface 88 of the side wall 14 and the corresponding at least one longitudinal groove 47 in the pole 45, thereby dividing the hollow interior of the container into at least two compartments. Alternately, and as shown in FIG. 16, a tubular portion 96 of the divider 29 may slide over the pole 45 to removably attach the divider 29 to the pole 45. Multiple dividers 29 may be attached to the interior surface of the side wall to divide the hollow interior into multiple sections, depending on the number of openings 36 in the top wall.

Figure 7:
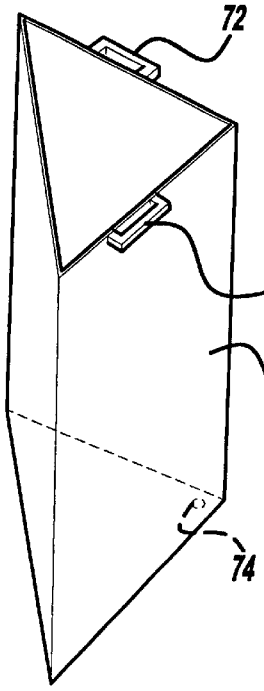
FIG. 7 is a perspective view of a canister used in a third embodiment of the advertising display device of the present invention.

At least two removable canisters 70 may be emplaced within the hollow interior, one in each of the compartments formed in the hollow interior by the dividers 29 below each of the openings formed through the top wall. These canisters 70 replace the frame of the first embodiment. As shown in FIG. 7, the canisters 70 may have handles 72, 72' integrally formed therewith or attached thereto to enable ease of handling. The canisters 70 need not all be the same shape, and, preferably, correspond to the shapes of the apertures 36 in the top wall 12. Each canister 70 may contain an aperture 74 formed therethrough to allow runoff of rain water or other liquids from the interior thereof that might have entered through the apertures 36 in the top wall. In this way, several types of waste may be separably deposited in, and collected from, the device to increase ease of recycling. For instance, one of the openings may be for paper; another for aluminum; another for plastic; etc.

Figure 15:
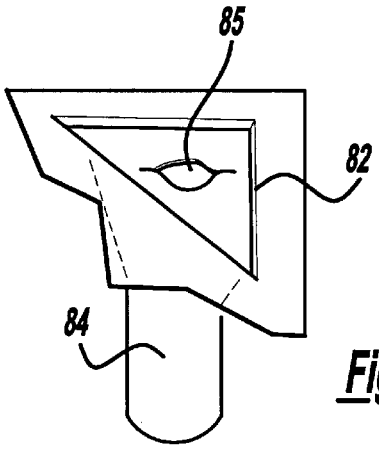
FIG. 15 is a perspective view of a portion of the top of the third embodiment hereof and a canister used in the third embodiment hereof.

As shown in FIG. 14, at least one additional aperture 82 may be formed through the top wall 12. As shown in FIG. 15, disposed in the hollow interior 30 beneath each aperture 82 is a fireproof canister 84. The canister 84 may have a bladder-like top 86, as shown in FIG. 15, or may simply have an open top (not shown). The at least one aperture 82 and corresponding fireproof canister 84 are designed for the deposit of cigarettes and similar flammable materials. The apertures 82 need not all be the same shape as each other or as the apertures 36.

In all other respects, the third embodiment is similar to that of the first embodiment.

Figure 17:
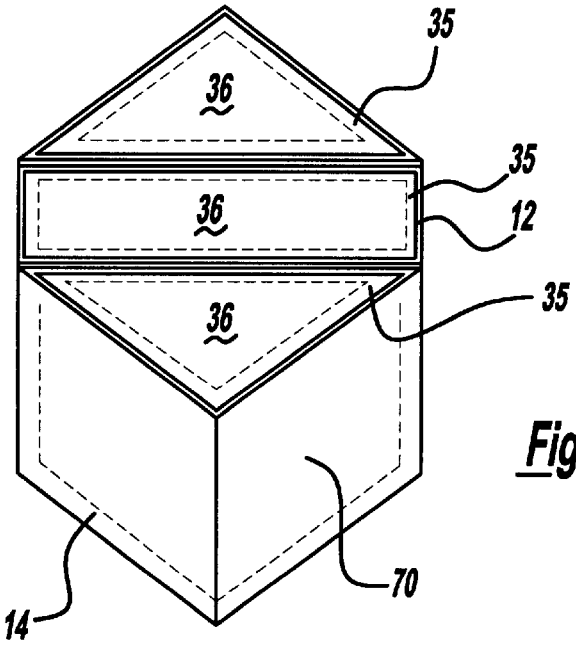
FIG. 17 is a perspective view of a fourth embodiment hereof.

In a fourth embodiment of the present invention, and as shown in FIG. 17, a pole and dividers are not be used to separate the hollow interior into compartments. As in the third embodiment, at least two, and preferably at least three, flaps 35 cover at least two, and preferably three, openings 36 in the top wall 12, one flap per opening, and a canister 70 sits in the hollow interior beneath each of the openings 36 in the top wall 12. In all other respects, the fourth embodiment is similar to the third embodiment.

While the invention has been illustrated and described in detail in the drawings and the foregoing description, the same is to be considered as illustrative and not restrictive in character, it being understood that only the preferred embodiments have been shown and described fully and that all changes and modifications that come within the spirit of the invention are desired to be protected.

Having thus described the present invention, what is claimed is:

1. A waste receptacle comprising:

a front section, said front section including a front panel, a pair of opposing side panels, a top panel and a bottom panel, all being integral with each other, one of the side panels including a first hinge device, said top panel having an arced shape and including at least one opening extending therethrough, said front panel including an advertising media display device; and a back panel, said back panel being a planar member having about the same shape as the front panel, said back panel combining with the front section to define an enclosure, said back panel including a second hinge device that is coupled to the first hinge device so that the front section is pivotally secured to the back panel, said back panel including a mounting device for mounting the receptacle to a fixed structure, wherein the front section pivots away from the back panel to allow access to the enclosure when the back panel is mounted to the structure.

2. The receptacle according to claim 1 further comprising means maintaining the front panel in a closed position.

3. The receptacle according to claim 1 wherein the at least one opening in the top panel is angularly offset relative to a center line of the top panel.

4. The receptacle according to claim 3 wherein the at least one opening is two openings extending through the top panel, wherein both openings are angularly offset relative to the center line and are symmetric thereto.

5. The receptacle according to claim 1 wherein the mounting device includes means for supporting the receptacle on the structure off of the ground.

6. The receptacle according to claim 1 wherein the advertising media display device includes a transparent layer mounted to and cooperating with an exterior surface of the front panel to define a space between the transparent layer and the front panel, the space defining a pocket, advertising media being insertable into the pocket for display, said advertising media display device including means for attaching the transparent layer to the front panel.

7. The receptacle according to claim 6 further comprising a magnetic border peripherally surrounding the transparent layer, the magnetic border defining the means for attaching the transparent layer to the front panel.

8. The receptacle according to claim 1 further comprising a frame member mounted to the back panel within the enclosure, said frame member configured to hold a waste bag in a position so that waste deposited through the at least one opening is adapted to fall into the bag.

9. The receptacle according to claim 1 further comprising a frame member mounted to the front section within the enclosure, said frame member configured to hold a waste bag in a position so that waste deposited through the at least one opening is adapted to fall into the bag.

10. The receptacle according to claim 1 further comprising a divider positioned within the enclosure, said divider separating the enclosure into first and second separated areas.

11. A waste receptacle comprising:

a front section, said front section including a front panel, a pair of opposing side panels, a top panel and a bottom panel, all being integral with each other, one of the side panels including a first hinge device, said top panel having an arced shape and including at least one opening extending therethrough, wherein the at least one opening in the top panel is angularly offset relative to a center line of the top panel, and wherein the front panel includes an advertising display device; and a back panel, said back panel being a planar member having about the same shape as the front panel, said back panel combining with the front section to define an enclosure, said back panel including a second hinge device that is coupled to the first hinge device so that the front section is pivotally secured to the back panel, wherein the front section pivots away from the back panel to allow access to the enclosure when the back panel is mounted to a fixed structure.

12. The receptacle according to claim 11 further comprising a mounting device for mounting the receptacle to the fixed structure.

13. The receptacle according to claim 12 wherein the mounting device includes means for supporting the receptacle on the structure off of the ground.

14. The receptacle according to claim 11 wherein the at least one opening is two openings extending through the top panel, wherein both openings are angularly offset relative to the center line and are symmetric thereto.

15. The receptacle according to claim 11 further comprising a frame member mounted to the back panel within the enclosure, said frame member configured to hold a waste bag in a position so that waste deposited through the at least one opening is adapted to fall into the bag.

16. The receptacle according to claim 11 further comprising a frame member mounted to the front section within the enclosure, said frame member configured to hold a waste bag in a position so that waste deposited through the at least one opening is adapted to fall into the bag.

17. The receptacle according to claim 11 further comprising a divider positioned within the enclosure, said divider separating the enclosure into first and second separated areas.

18. The receptacle according to claim 11 wherein the advertising display device includes a transparent layer mounted to and cooperating with the exterior surface of the front panel to define a space between the transparent layer and the front panel, the space defining a pocket, advertising media being insertable into the pocket for display, said display device further includes means for attaching a transparent layer to the front panel.

* * * * *